US007609217B2

(12) United States Patent
Noro et al.

(10) Patent No.: US 7,609,217 B2
(45) Date of Patent: Oct. 27, 2009

(54) ANTENNA DEVICE

(75) Inventors: Junichi Noro, Akita (JP); Satoshi Kohno, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/954,326

(22) Filed: Dec. 12, 2007

(65) Prior Publication Data

US 2008/0180332 A1 Jul. 31, 2008

(30) Foreign Application Priority Data

Jan. 25, 2007 (JP) ..... P2007-014800

(51) Int. Cl.
*H01Q 1/32* (2006.01)

(52) U.S. Cl. ..... 343/713; 343/711

(58) Field of Classification Search ..... 343/711, 343/713, 700 MS, 702
See application file for complete search history.

(56) References Cited

U.S. PATENT DOCUMENTS 4,821,040 A * 4/1989 Johnson et al. ..... 343/700 MS
5,828,339 A * 10/1998 Patel ..... 343/700 MS
2002/0047809 A1* 4/2002 Ikeda et al. ..... 343/713
2005/0068236 A1* 3/2005 Noro ..... 343/713
2006/0262018 A1* 11/2006 Mikami et al. ..... 343/713

FOREIGN PATENT DOCUMENTS

| | | |
|---|---|---|
| JP | 10-329615 | 12/1998 |
| JP | 2003-17154 | 1/2003 |
| JP | 2005-109688 | 4/2005 |

* cited by examiner

*Primary Examiner*—HoangAnh T Le
(74) *Attorney, Agent, or Firm*—Whitham Curtis Christofferson & Cook, PC

(57) ABSTRACT

An antenna device attachable to a bottom surface of a resin or glass body of a vehicle, the antenna device includes: an antenna element that has a receiver for receiving radio waves; a circuit board that has a circuit surface having a circuit formed thereon to amplify signals inputted from the antenna element; a shield cover that covers the circuit surface of the circuit board to shield the circuit from interference waves and that is grounded; a coaxial cable that is inserted into the shield cover, that supplies a driving power to the circuit formed on the circuit board, that connects the circuit to a GND, and that outputs signals from the circuit; and a metallic bracket that has a lateral wall surrounding a lateral side of the antenna element and a bottom wall supporting a bottom of the antenna element.

5 Claims, 3 Drawing Sheets

ANTENNA DEVICE

BACKGROUND

1. Technical Field

The present invention relates to an antenna device, and more particularly, to an antenna device mounted on a vehicle having a body made of resin or glass.

2. Related Art

When an antenna device of a GPS system for a vehicle widely used as a positioning system or an antenna device used for a satellite radio coming into practical use in the United States is mounted on a vehicle such as a car, an antenna element stored in a case is installed generally on the outer rear such as a roof of the vehicle (see Patent Documents 1, 2, etc.). In this case, the case of the antenna device may be attached to a metallic roof of the vehicle, for example, by the use of a permanent magnet or the like.

However, the vehicle having a roof made of resin or glass containing glass fiber resin such as glass fiber has been manufactured in recent years. Accordingly, it is difficult to attach the antenna device to the roof by the use of the magnet or the like. Thus, in case of such a vehicle, the antenna device is attached to the top surface of the roof by the use of adhesives or the like, and a metallic plate or a metallic sheet such as aluminum is installed on the bottom surface, that is, on the indoor surface of the vehicle.

Since the roof of such a vehicle is made of resin or glass, it is possible to install the antenna device on the bottom surface of the roof. Thus, there was proposed an automobile parts with built-in antenna in which a bottom plate of an antenna device is attached to a rib protruding from a bottom surface of a roof (see Patent Document 3).

Patent Document 1: JP-A-2005-109688

Patent Document 2: JP-A-2003-17154

Patent Document 3: JP-A-10-329615

However, in a satellite radio of the United States, a geostationary satellite may be located at a relatively low position on the Pacific. If a low elevation angle directivity gain of the antenna element is not large, electric waves of the satellite radio may not be sufficiently received. Accordingly, there is a case to obtain a sufficient low elevation angle directivity gain of the antenna element while not limited to the satellite radio.

From this point of view, since the roof of the vehicle of the known antenna device is made of metal, the roof of the antenna device serves as a GND of the antenna device. Further, since the roof sufficiently attracts the electric waves, the low elevation angle directivity gain is sufficiently obtained only by installing the antenna element on the top surface of the roof. Accordingly, the low elevation angle directivity gain is sufficient.

However, when the roof of the vehicle is made of resin or glass, the roof does not serve as the GND of the antenna element and does not attract the electric waves. As disclosed in Patent Document 3, even when the bottom plate of the antenna device attached to the rib protruding from the bottom surface of the roof is made of metal, the area thereof is not sufficiently large and it is difficult to obtain a sufficient low elevation angle directivity gain.

In case of the bottom plate of the antenna device in Patent Document 3, or in case of the metallic plate or the metallic sheet installed on the bottom surface of the roof when the above-described antenna element is installed on the top surface of the roof, the area thereof may be widened to sufficiently attract the electric waves. However, it is actually difficult to install the bottom plate or the metallic plate on the entire back surface, which is not preferable in appearance design.

SUMMARY

An object of the invention is to provide an antenna device attached to the bottom surface of the body made of resin or glass in the vehicle, which is capable of sufficiently obtaining a low elevation angle directivity gain of received signals.

A first aspect of the invention provides an antenna device attachable to a bottom surface of a resin or glass body of a vehicle, the antenna device including: an antenna element that has a receiver for receiving radio waves; a circuit board that has a circuit surface having a circuit formed thereon to amplify signals inputted from the antenna element; a shield cover that covers the circuit surface of the circuit board to shield the circuit from interference waves and that is grounded; a coaxial cable that is inserted into the shield cover, that supplies a driving power to the circuit formed on the circuit board, that connects the circuit to a GND, and that outputs signals from the circuit; and a metallic bracket that has a lateral wall surrounding a lateral side of the antenna element and a bottom wall supporting a bottom of the antenna element.

According to a second aspect of the invention, the lateral wall of the bracket may have a regular-polygon shape or a round shape in a horizontal sectional view in the antenna device according to the first aspect of the invention.

According to a third aspect of the invention, the body may be one of a roof, an instrument panel, a rear parcel shelf, a trunk lid, a front glass, and a rear glass in the antenna device according to the first or second aspect of the invention.

According to the first aspect of the invention, the lateral wall of the metallic bracket is provided to surround the lateral side of the antenna element. Therefore, the radio waves are attracted downward by the lateral wall of the bracket in the position closest to the receiver of the antenna element.

For this reason, even when the area of the bracket of the antenna device attached to the bottom surface of the body made of resin or glass is not so large, it is possible to obtain a sufficient low elevation angle directivity gain of signals of received radio waves and it is possible to further improve the obtained low elevation angle directivity gain.

In addition, the bracket for supporting the antenna element or the like is made of metal so that the bracket serves as the GND of the antenna element. Accordingly, even in a case where it is difficult to secure the sufficient GND due to the attachment to a non-metallic body, it is possible to secure the sufficient GND of the antenna element.

According to the second aspect of the invention, the lateral wall of the bracket of the antenna device has the regular-polygon shape including the square shape or the round shape in the horizontal sectional view. Therefore, since the signals of radio waves around the antenna element are uniformly attracted to the lateral wall of the bracket, it is possible to improve the low elevation angle directivity gain in all directions of the antenna element, in addition to the advantage according to the first aspect of the invention.

According to the third aspect of the invention, it is possible to attach the antenna device to the roof, the instrument panel, the rear parcel shelf, the trunk lid, the front glass, or the rear glass in the vehicle. Therefore, it is possible to determine the attachment position according to user's preference. In addition, even when the antenna device is attached to any position, it is possible to effectively exhibit the advantages of the antenna device according to all the aspects of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of an antenna device according to the invention will be described with reference to the drawings.

Figure 1:
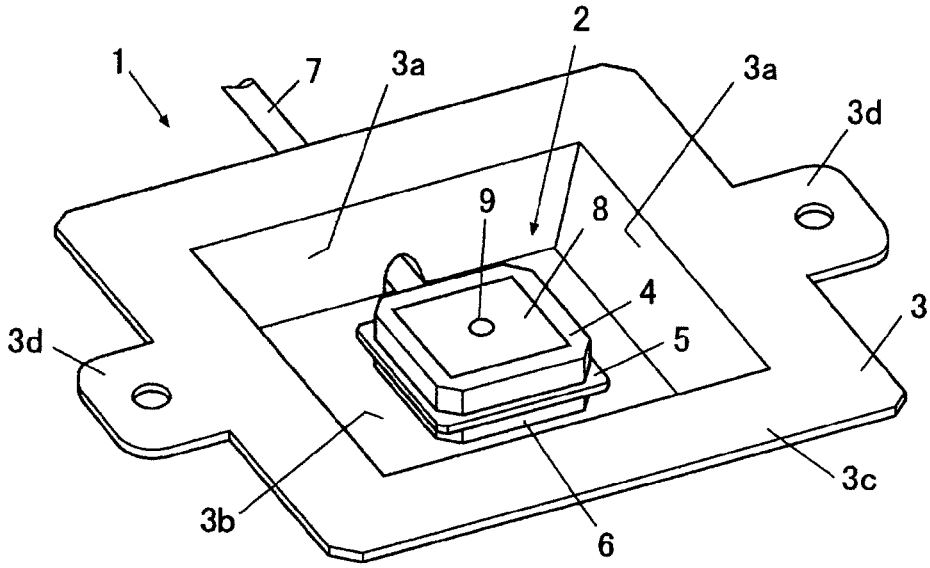
FIG. 1 is a perspective view illustrating a configuration of an antenna device according to an embodiment.
Figure 3:
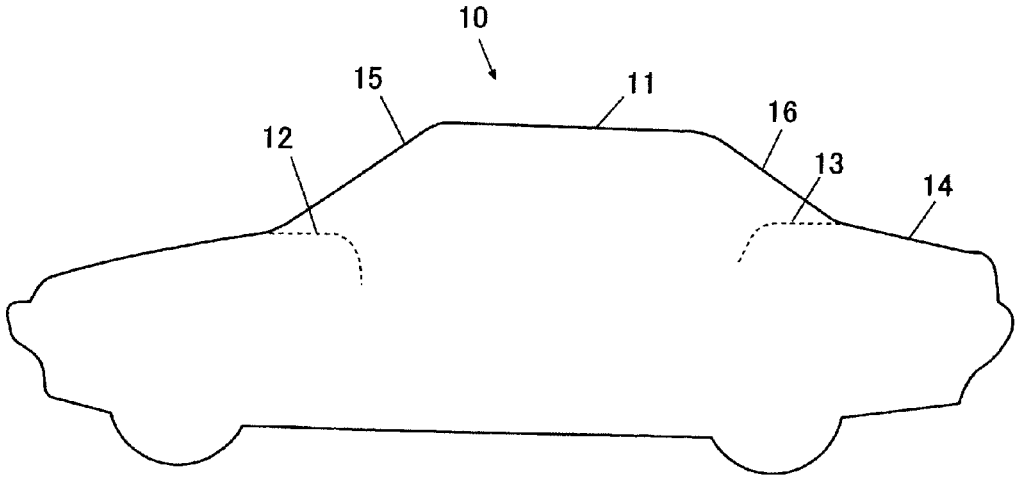
FIG. 3 is a view illustrating positions in a vehicle where an antenna device is attached.

As shown in FIG. 3, an antenna device 1 according the embodiment is an antenna device attached to a bottom surface of a body made of resin or glass containing glass fiber resin such as glass fiber in a vehicle. As shown in FIG. 1, the antenna device 1 mainly includes an antenna body 2 and a bracket 3.

Figure 2:
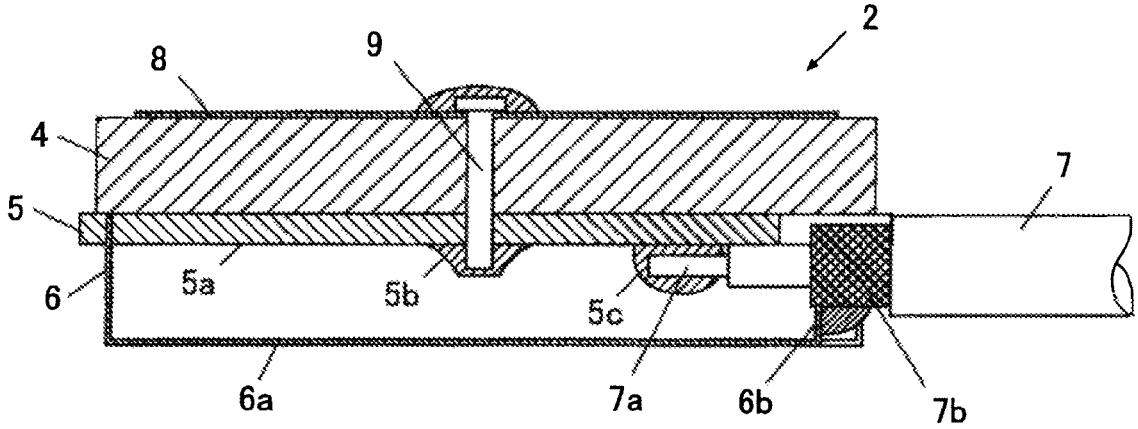
FIG. 2 is a schematic sectional view of an antenna body.

As shown in a lateral sectional view of FIG. 2, the antenna body 2 includes an antenna element 4, a circuit board 5, a shield cover 6, a coaxial cable 7, and the like.

In the embodiment, the antenna element 4 is made of ceramic and has a slightly thick plate shape. A patch-type reception surface 8 as a receiver for receiving radio waves is printed on the top surface of the antenna element 4. FIG. 2 shows the reception surface 8 of the antenna element 4 thicker than an actual one. A GND pattern (not shown) formed of a metallic thin film is attached to the substantially entire bottom surface of the antenna element 4 except for an input pin 9 and the vicinity of the input pin 9.

A circuit board 5 is provided on the bottom surface of the antenna element 4. On the top surface of the circuit board 5, that is, on the surface having the antenna element 4 disposed thereon, a GND pattern (not shown) different from the GND pattern of the antenna element 4 is attached to the substantially entire surface thereof except for the input pin and the vicinity of the input pin 9. The GND pattern surface of the circuit board 5 and the GND pattern surface of the antenna element 4 are attached to each other, for example, by the use of an adhesive member such as a two-sided tape so that the antenna element 4 and the circuit board 5 are adhered to each other. The GND pattern of the circuit board 5 also serves as a GND pattern of the antenna element 4, together with the GND pattern of the antenna element 4.

Circuit components (not shown) that amplifies and outputs the signals inputted from the antenna element 4 are disposed on the bottom surface of the circuit board 5, that is, on a circuit surface 5*a*, thereby forming an amplification circuit. The circuit board 5 is provided with a plurality of through-holes (not shown) at proper positions, and the GND of the amplification circuit provided on the circuit surface 5*a* and the GND pattern provided on the top surface opposite to the circuit surface 5*a* are connected to each other through the through-holes.

The input pin 9 passes through and is inserted to predetermined positions of the antenna element 4 and the circuit board 5 in a direction perpendicular to the reception surface 8 of the antenna element 4 and the circuit surface 5*a* of the circuit board 5. In the embodiment, one end of the input pin 9 is electrically connected to the reception surface 8 of the antenna element 4 by the use of solder.

The other end of the input pin 9 is electrically connected to the amplification circuit provided on the circuit board 5 by the use of solder, and the connection portion serves as an input portion 5*b* of the circuit. The signals of the radio waves received by the reception surface 8 of the antenna element 4 is inputted to the amplification circuit of the circuit board 5 through the input portion 5*b* of the input pin 9.

The substantially box-shaped shield cover 6 made of metal is attached to cover the circuit surface 5*a*, on the circuit surface 5*a* side of the circuit board 5. The shield cover 6 shields the circuit surface 5*a* from interference waves coming from the outside to the circuit surface 5*a*. A base surface 6*a* of the substantially box-shaped shield cover 6 is disposed parallel to the reception surface 8 of the antenna element 4 or the circuit surface 5*a* of the circuit board 5.

In the embodiment, apart of the shield cover 6 has a protrusion shape and engages with a notch (not shown) formed in the circuit board 5, thereby positioning the shield cover 6 with respect to the circuit board 5. Although not shown, in the embodiment, the shield cover 6 is electrically connected to the GND formed on the circuit surface 5*a* of the circuit board 5 by the use of solder or the like.

The coaxial cable 7 is inserted into the shield cover 6. A core 7*a* of the coaxial cable 7 is electrically connected to the amplification circuit provided on the circuit surface 5*a* of the circuit board 5 by the use of solder, and the connection portion serves as an output portion 5*c* of the circuit. A driving power is supplied to the amplification circuit through the core 7*a* of the coaxial cable 7, and the signals received by the antenna element 2 and amplified by the amplification circuit are outputted to the downstream side of the coaxial cable 7 through the output portion 5*c*.

A tongue piece 6*b* curved from the base surface 6*a* of the shield cover 6 toward the coaxial cable 7 is formed in the shield cover 6, and the tongue piece 6*b* is electrically connected to an outer conductor 7*b* of the coaxial cable 7 by the use of solder. A GND potential is supplied to the outer conductor 7*b* of the coaxial cable 7, the circuit of the circuit board 5 is connected to the GND from the outer conductor 7*b* through the tongue piece 6*b* and the shield cover 6.

As shown in FIG. 1, the metallic bracket 3 that has a lateral wall 3*a* surrounding the lateral side of the antenna element 4 and a bottom wall 3*b* supporting the bottom of the antenna body 2 including the antenna element 4 is disposed in the vicinity of the antenna body 2 including the antenna element 4. In the embodiment, the bracket 3 has a square-dish shape formed of the lateral wall 3*a* and the bottom wall 3*b* that are flat, and the lateral wall 3*a* has a substantially regular square shape in the horizontal sectional view.

Figure 4:
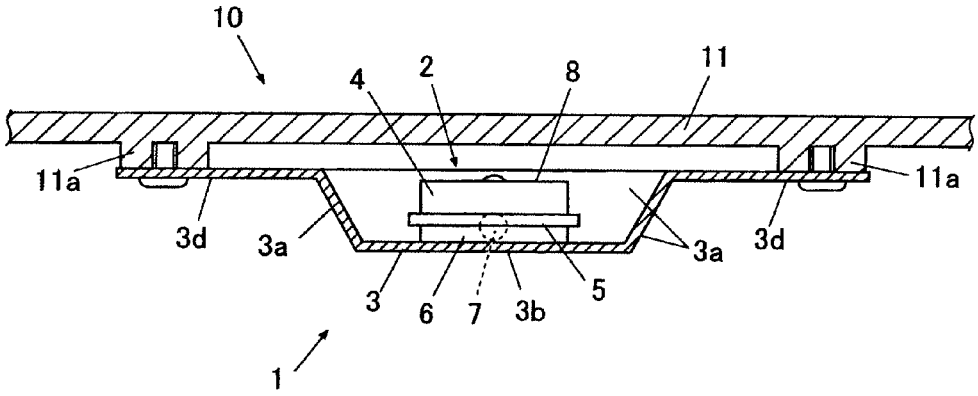
FIG. 4 is a partial sectional view illustrating an antenna device attached to a body of a vehicle.

Preferably, the lateral wall 3*a* of the bracket 3 has a regular-polygon shape including the regular square shape or a round shape in the horizontal sectional view as shown in the embodiment, but the lateral wall 3*a* may have, for example, a rectangular shape in the horizontal sectional view. As shown in FIG. 4, the height of the lateral wall 3*a* of the bracket 3 from the bottom wall 3*b* is formed preferably to be equal to the height of the reception surface 8 of the antenna element 4.

The antenna body 2 is placed on the bottom wall 3*b* of the bracket 3. In the embodiment, the antenna body 2 is fixed to the bracket 3 by attaching the base surface 6*a* of the shield cover 6 to the bottom wall 3*b* of the bracket 3, for example, by the use of to an adhesive member such as a two-sided tape.

In the embodiment, a flange 3*c* extends from the upper portion of the lateral wall 3*a* of the bracket 3 to be parallel to the bottom wall 3*b*, and two parts of the flange 3*c* each have an attachment portion 3*d* that further extends in a tongue piece shape.

As shown in FIG. 3, the antenna device 1 according to the embodiment may be attached to the bottom surface of the body made of resin or glass including glass fiber resin such as glass fiber in the vehicle 10, that is, to a front glass 15 or a rear glass 16 in addition to a roof 11, an instrument panel 12, a rear parcel shelf 13, or a trunk lid 14.

In the embodiment, the antenna device 1 is attached to the bottom surface of the roof 11 of the vehicle 10.

As shown in FIG. 4, two ribs 11*a* protrudes from the bottom surface of the roof 11 of the vehicle 10, and a screw boss is formed in each ribs 11*a*. The antenna device 1 is fixed to the roof 11 of the vehicle 10 in such a manner that the attachment portion 3*d* of the bracket 3 is coupled to the screw bosses of the ribs 11*a* by the use of screws.

When the ribs 11*a* having the screw bosses formed therein are not formed on the roof, the antenna device 1 may be fixed to the roof 11 in such a manner that the roof 11 is cut in for screws or a simple hook is attached to the roof 11 to couple the attachment portion 3*d* thereto. The antenna device 1 may be attached to the roof 11 or the like in another manner, but the manner to fix the antenna device is not limited to the manner using the screws.

Next, an operation of the antenna device 1 according to the embodiment will be described.

In the antenna device 1 that receives high-frequency signals according to the embodiment, it is difficult that the voltage leaks from the amplification circuit due the high frequency characteristics and it is easy that the voltage remains. However, as described in the embodiment, the GND pattern is provided on the bottom surface of the antenna element 4 of the antenna device 1 and further the GND pattern formed on the circuit board 5 grounded through the shield cover 6 by the outer conductor 7*b* of the coaxial cable 7 is connected to the GND of the antenna element 4, and thus it is possible to lower the GND level of the amplification circuit.

In the antenna device 1 according to the embodiment, since the metallic bracket 3 is disposed under the shield cover 6 of the antenna body 2, the bracket 3 serves as the GND of the antenna element 4, thereby further improving the whole GND efficiency of the antenna device 1.

Figure 5:
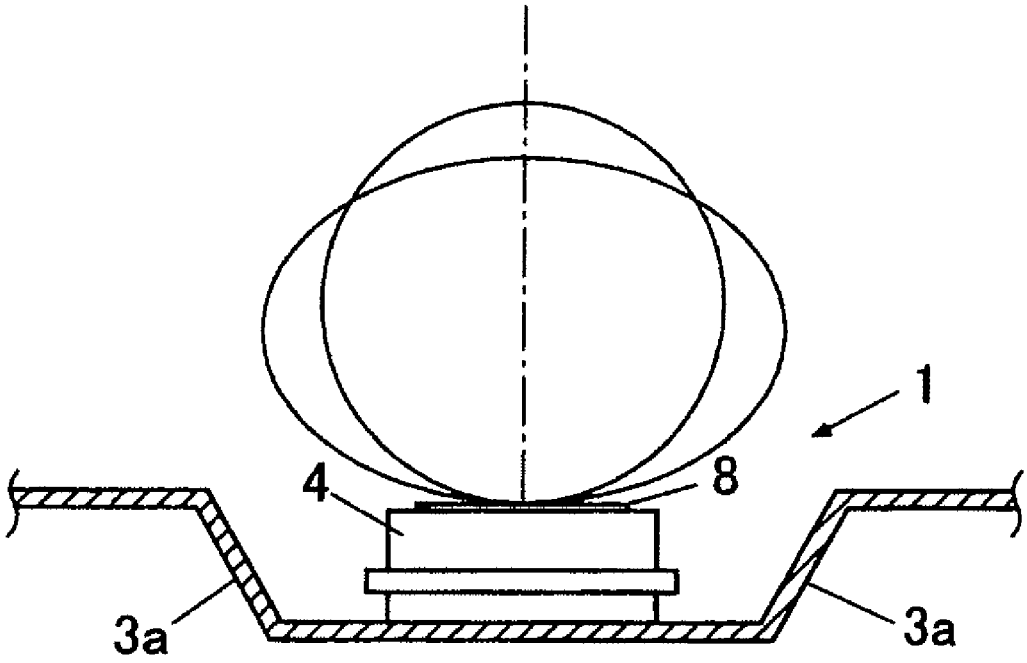
FIG. 5 is a view illustrating an elevation angle directivity gain of an antenna device.

In the antenna device 1 according to the embodiment, since the bracket 3 is provided with the lateral wall 3*a* to surround the lateral side of the antenna element 4, the radio waves are attracted to the lateral wall 3*a* of the metallic bracket 3 in the position thereof closest to the reception portion 8 of the antenna element 4. Accordingly, in a directivity gain in an elevation angle direction of the reception surface 8 represented by a circle in FIG. 5 in the normal state, the elevation angle increases at a lower portion as represented by an oval in FIG. 5.

For this reason, in the antenna device 1 according to the embodiment, it is possible to efficiently receive radio waves incident in a direction of the lower elevation angle by the reception surface 8 of the antenna element 4.

As described above, the antenna device 1 according to the embodiment is provided with the lateral wall 3*a* of the metallic bracket 3 surrounding the lateral portion of the antenna element 4, so that the radio waves are attracted downward by the lateral wall 3*a* of the bracket 3 in the position thereof closest to the reception surface 8 of the antenna element 4.

For this reason, even when the area of the bracket 3 of the antenna device attached to the bottom surface of the body made of resin or glass is not so large, it is possible to obtain a sufficient low elevation angle directivity gain of signals of received radio waves and it is possible to further improve the obtained low elevation angle directivity gain.

In addition, the bracket 3 for supporting the antenna element 4 or the like is made of metal so that the bracket 3 serves as the GND of the antenna element 4. Accordingly, even in a case where it is difficult to secure the sufficient GND due to the attachment to a non-metallic body, it is possible to secure the sufficient GND of the antenna element 4.

In the antenna device 1 according to the embodiment, the antenna element 4 is formed of a so-called patch antenna (planar antenna) having the reception surface 8. Accordingly, since the whole construction of the antenna device 1 is formed in a substantially plate shape as shown in FIG. 4 or the like, the antenna device 1 is not an obstacle to a rider in a vehicle.

In the antenna device 1, the lateral wall 3*a* of the bracket 3 has the regular-polygon shape including the square shape or the round shape in the horizontal sectional view. Accordingly, since the signals of radio waves around the antenna element 4 are uniformly attracted to the lateral wall 3*a* of the bracket 3, it is possible to improve the low elevation angle directivity gain in all directions of the antenna element 4.

The entire disclosure of Japanese Patent Application No. 2007-14800 filed on Jan. 25, 2007 is expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the sprit and scope of the invention.

What is claimed is:

1. An antenna device attachable to a bottom surface of a resin or glass body of a vehicle, the antenna device comprising:

an antenna element that has a receiver for receiving radio waves;

a circuit board that has a circuit surface having a circuit formed thereon to amplify signals inputted from the antenna element;

a shield cover that covers the circuit surface of the circuit board to shield the circuit from interference waves and that is grounded;

a coaxial cable that is inserted into the shield cover, that supplies a driving power to the circuit formed on the circuit board, that connects the circuit to a ground (GND) by an outer conductor of the coaxial cable being connected to the shield cover and a GND potential being supplied to the shield cover, and that outputs signals from the circuit; and a metallic bracket that has a lateral wall surrounding a lateral side of the antenna element and a bottom wall supporting a bottom of the antenna element, wherein the shield cover is mounted on the bottom wall so that the antenna element is supported by the metallic bracket.

2. The antenna device according to claim 1, wherein the lateral wall of the bracket has a regular-polygon shape or a round shape in a horizontal sectional view.

3. The antenna device according to claim 1, wherein the metallic bracket is configured for connection to one of a roof, an instrument panel, a rear parcel shelf, a trunk lid, a front glass, and a rear glass of said body.

4. The antenna device according to claim 1, wherein a height of the lateral wall is substantially the same as a reception surface of the antenna element.

5. The antenna device according to claim 1, wherein the metallic bracket further has: a flange extending in parallel to the bottom wall from the lateral wall; and an attachment portion that extends from the flange and adapted to attach the bottom surface of the body of a vehicle.

* * * * *